United States Patent [19]

Reida

[11] 4,061,396

[45] Dec. 6, 1977

[54] TIE DOWN FOR ROTATING SEAT CUSHIONS

[75] Inventor: William D. Reida, Green Mountain Falls, Colo.

[73] Assignee: AMI Industries, Inc., Colorado Springs, Colo.

[21] Appl. No.: 660,845

[22] Filed: Feb. 24, 1976

[51] Int. Cl.[2] ..... A47C 27/00

[52] U.S. Cl. ..... 297/283; 248/503.1

[58] Field of Search ..... 297/219, 250, 283, 223, 297/452, 331, 232, 248, 92; 248/503, 503.1; 296/63, 64

[56] References Cited

U.S. PATENT DOCUMENTS

| | | | |
|---|---|---|---|
| 241,620 | 5/1881 | Colby | 248/503.1 |
| 247,757 | 10/1881 | Havens et al. | 248/503.1 |
| 249,309 | 11/1881 | Comstock | 248/503.1 |
| 291,389 | 1/1884 | Newacheck | 248/503.1 |
| 656,391 | 8/1900 | Conrad | 297/283 |
| 660,651 | 10/1900 | Olmstead | 248/503.1 |
| 696,648 | 4/1902 | Lambert | 248/503.1 |
| 1,251,976 | 1/1918 | Ledwinka | 296/63 |
| 1,747,493 | 2/1930 | Snook | 297/283 |
| 2,059,875 | 11/1936 | Katz | 297/283 |
| 2,521,339 | 9/1950 | Burn | 297/283 |
| 3,171,685 | 3/1965 | Hershberger et al. | 297/92 |
| 3,208,085 | 9/1965 | Grimshaw | 297/452 X |
| 3,289,220 | 12/1966 | Grimshaw | 297/452 X |
| 3,876,250 | 4/1975 | Eberle | 297/452 X |
| 4,013,203 | 3/1977 | McCauley | 248/503 |

FOREIGN PATENT DOCUMENTS

| | | | |
|---|---|---|---|
| 724,291 | 7/1942 | Germany | 297/283 |

*Primary Examiner*—James T. McCall
*Attorney, Agent, or Firm*—W. Britton Moore

[57] ABSTRACT

This tie down for seat cushions, such as single and multiple mounted type vehicle seat cushions resides in tabs swivelly attached to the opposing sides of the seat cushions and depending downwardly therefrom with the apertures being formed therein adjacent the free ends thereof. Upstanding hooks having bent ears thereon are anchored in the seat frames adjacent the side and center arm rest frames whereby cushions horizontally supported by the seat frames may be detached therefrom and rotated or reversed and reattached to and restrained by the hooks so as to present a clean or unworn seating surface when desired.

2 Claims, 7 Drawing Figures

TIE DOWN FOR ROTATING SEAT CUSHIONS

This invention relates to a tie down means for vehicle seat cushions and the like including apertured tabs swivelly attached to the opposing sides of the seat cushions and engaging with hooks arranged on the seat frames to enable detachment of the cushions therefrom, and rotation or reversal reattachment thereof to present a clean or unworn seating surface when desired.

The principal object of the present invention resides in the provision of tie down tabs swivelly attached to seat cushions, which may be of the single or multiple vehicle seat type, and depending downwardly therefrom and having apertured free ends to receive bent ears on upstanding hooks anchored in the seat frames so that the seats may be detached and rotated and reattached to present an unsoiled seating surface.

A further object is to provide novel tie down tabs for swivel attachment to the sides of vehicle seat cushions and having apertures in the free downwardly depending ends for receiving bent ears on upstanding hooks anchored in the seat frames whereby the tabs will swivel to enable rotation thereof and detachment therefrom and reversal of the seat when a change of seating surfaces is desired.

Another object is to provide a generally U-shaped anchoring hook anchored in the seat frames and extending upwardly therefrom and having bent ears on the upper ends thereof for interengagement and disengagement with the apertured swivel tie down tabs on the seat cushions.

Still another object is the provision of a tie down tab for securement to the sides of seat cushions and having apertures in the ends thereof for engagement in one aperture thereof of the bent ear on an upstanding anchoring hook so that the cushions may be disengaged therefrom and rotated and reversed, with the tabs being foldable when so reversed so that they will then depend from the other seat surface to enable anchoring reattachment.

These and other objects and advantages will be apparent as the specification is considered with the accompanying drawings, wherein FIG. 1 is a perspective view of a dual type vehicle seat, such as an aircraft or railroad passenger seat;

Figure 1:
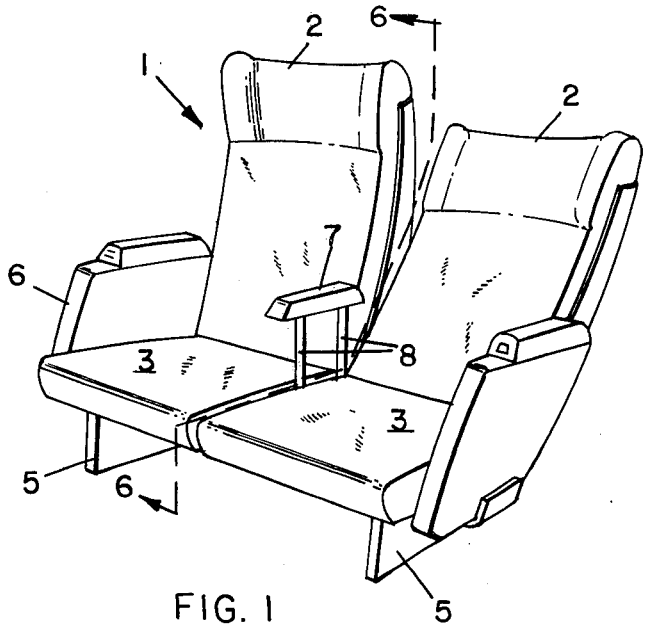

Referring more particularly to the drawings wherein similar reference characters designate like parts throughout the several views, numeral 1 generally designates a dual type vehicle seat, such as an aircraft or railroad passenger seat, having reclining upholstered backs 2, contoured seat cushions 3 supported by a metal base frame 4, arranged on and supported by spaced pedestals 5. Side arm rests 6 at the outer sides of the seat are suitably secured to the base frame 4, and together with a centrally arranged upstanding arm rest 7 arranged on posts 8 also suitably mounted in sockets 10 in a center cross member 9 of base frame 4 between the cushions 3 provide arm support for the seat occupants.

Figure 6:
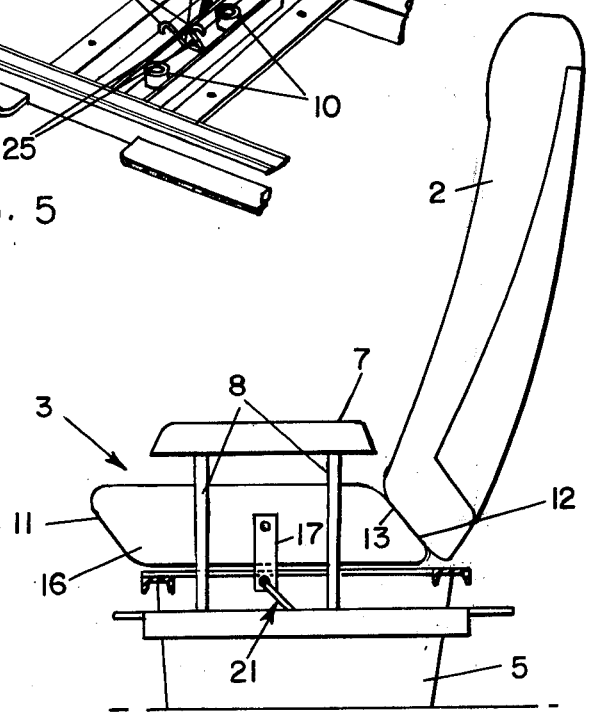
FIG. 6 is a side view of a vehicle seat along the line 6—6 of FIG. 1.

The seat cushions are contoured to provide rounded and inwardly sloping front and rear edges 11 and 12 so as to respectively better accommodate the legs of the occupants and to interfit correspondingly angled and contoured bottom edges 13 on backs 2, as best shown in FIG. 6.

Figure 2:
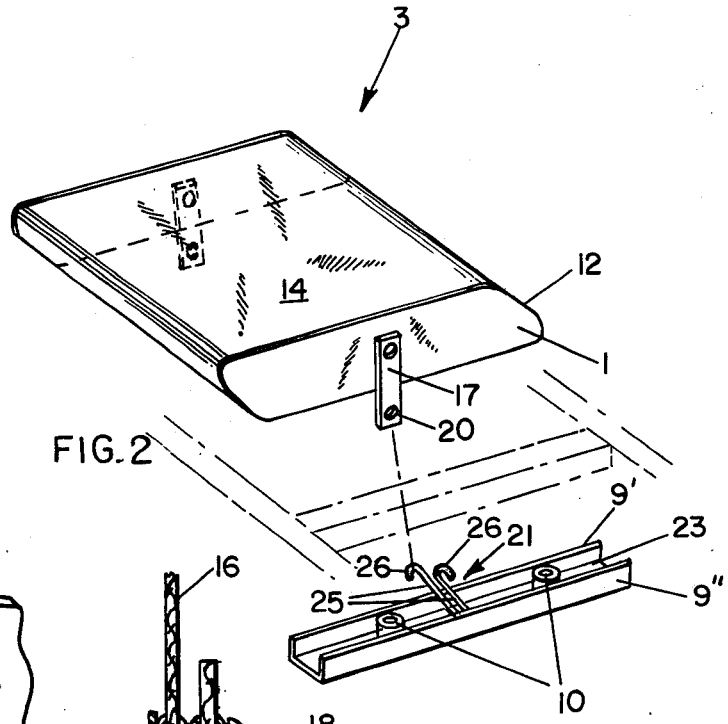
FIG. 2 is an exploded perspective view of a seat cushion showing the relationship of one tie down tab swivelly attached to a side thereof to an upstanding anchoring hook.
Figure 3:
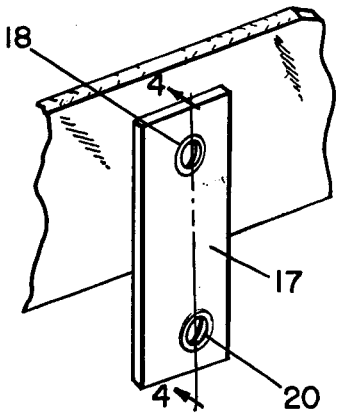
FIG. 3 is a perspective view of a tie down tab swivelly attached to a side of a seat cushion.
Figure 4:
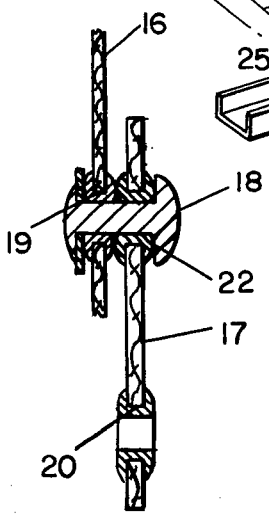
FIG. 4 is a section on the line 4—4 of FIG. 3.
Figure 5:
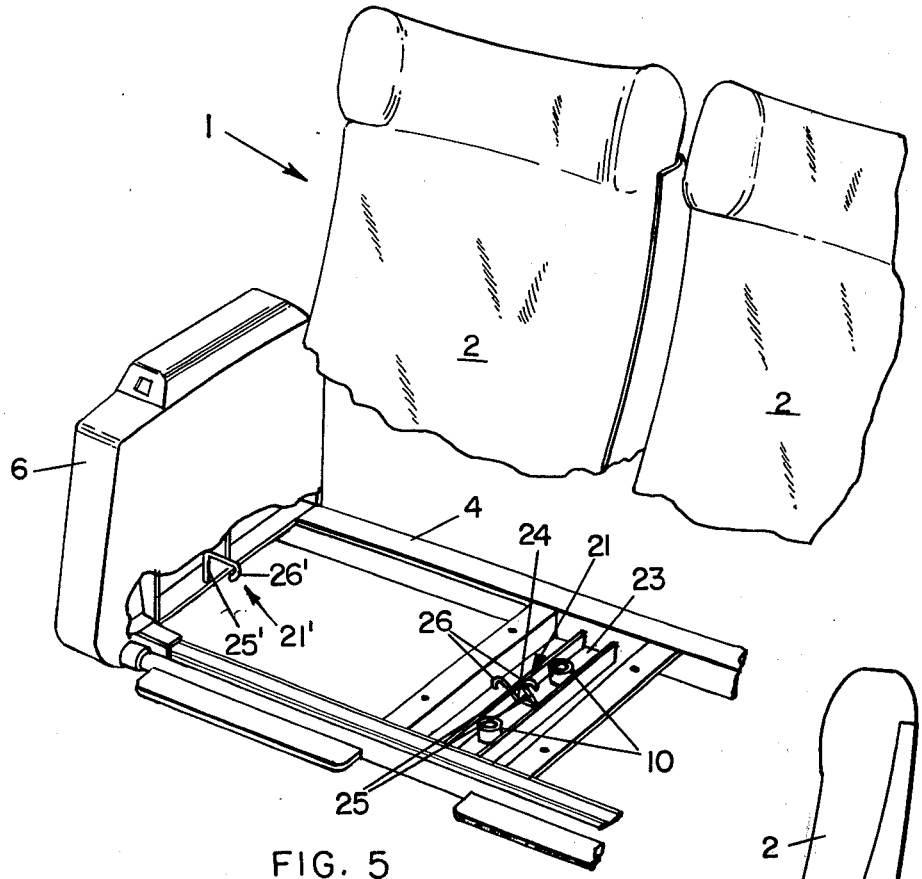
FIG. 5 is a front view of a portion of a dual type vehicle seat, partly broken away to show the seat and arm rest supporting frames thereof.

As the flat upper and lower seating surfaces 14–15 of the cushions tend to become soiled and/or worn through use, it is desirable that they be reversible to present different surfaces as needed. In the preferred embodiment of FIGS. 2 to 6, each cushion 3 is provided with generally flat sides 16 in the approximate center of each is swivelly mounted a relatively narrow flat tie down tab 17, which may be of any suitable material, such as metal or plastic, extending downwardly below the lower seating surface 15, as best shown in FIGS. 2, 3 and 6. The tabs are suitably swivally mounted in apertures 19 in the sides 16, such as by rivets 18 which extend through apertures 19, adjacent the upper ends of the tabs. Apertures 20 also formed in the tabs, adjacent the lower ends, receive attaching hooks 21, anchored in seat cross frame member 9 and projecting upwardly and forwardly thereof at an angle of approximately 45°. To facilitate swivelling of the tabs to enable reattachment upon rotation of the cushions relative to the tabs 17, the rivets 18 may extend through grommets 22 arranged in apertures 19—19'.

The attaching hook 21 for engaging with the tab apertures 20 in tabs 17 on the opposing and adjoining side faces 16 of the cushions, which are rather closely spaced, as in FIG. 1, is generally U-shaped with a closed lower end 24 engaging with the flat upper face 23 of center cross frame member 9 of seat frame 4 and interfitting between the upstanding sides 9' and 9" thereof. Lower end 24 may be suitably secured and anchored thereto by welding or the like. The arms 25 of the hook will extend upwardly and the upper ends will curve oppositely outwardly and downwardly to provide ears 26 adapted to interengage apertures 20 in the tabs on the cushion sides closest thereto, for a purpose presently to be described. The configuration of the hook may be formed by suitable bending or machining operations.

As only single hooks are required to engage with the tabs on the sides of the cushions adjacent side arm rests 6, a modified hook 21' is suitably anchored in the base frame portion of each side arm rest 6 and each is formed with a post 25' extending generally horizontally and inwardly therefrom and, thence, curved laterally and forwardly to provide ears 26' for interengaging apertures 20 of the tabs on the adjacent cushion sides. Thus, the center and end hooks 21—21' and the ears 26—26' thereon will engage and function to anchor and retain the cushions on their seat frames. In addition, and more importantly, when it is desired to reverse the cushion to present unsoiled seating surfaces, the hook ears 26—26' are disengaged from the cushion tabs at either side of the cushion so that the latter may be manually rotated or reversed approximately 180°, after which the tabs will be swivelled so that their positions will also be reversed and will now depend from the uppermost cushion seat surface. Thus, the lower surface 15 will now be uppermost and the contoured rear edge 12 will be disposed forwardly. In other words, the cushion will be completely reversed, in an obvious manner.

Figure 7:
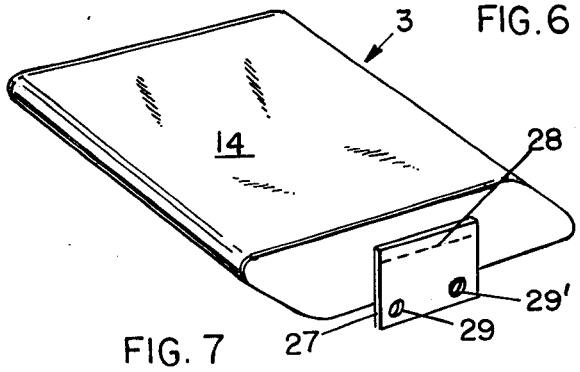
FIG. 7 is a perspective view of a seat cushion with a modified form of tie down tab secured thereto.

In the embodiment of FIG. 7, a generally rectangular shaped flat tie-down tab 27 may be substituted for the preferred swivel type tab 17, with the former being of a flexible material, such as fabric, which may be fixedly secured adjacent its upper edge by a row of stitching 28 to each side of the seat cushions along the center axes thereof. Spaced apertures 29—29' will be provided adjacent the lower edge which projects below a seating surface of the cushion. Thus, the ears 26—26' on hooks 21—21' will be arranged in the forwardmost apertures 29 in the 45° position of attaching hook 21. When the hooks 21—21' are detached from apertures 29 and the cushion is reversed, as described above, the tabs 27 may be folded or flexed outwardly and downwardly about their lines of stitching, in an obvious manner, rather than swivelling as with tabs 17. Thus, the apertures 29' will now be forwardmost so that the ears 26—26' on hooks 21—21' may be readily inserted therein to reanchor the cushion in its reversed position.

Due to the 45 degree angular position of hook 21, and the arrangement of side hooks 21', the ears 26—26' will exert a downward pressure on either the tabs 17 or 27 thereby holding the cushions in proper position within their seat frames and preventing them from sliding forwardly relative thereto.

While preferred and modified forms of tie-down tabs and attaching hooks have been shown and described, as applied to dual type vehicle seats, it is to be understood that these are also adaptable for use with other type seats, such as single and multiply arranged seats, and that various changes and improvements may be made therein without departing from the scope and spirit of the appended claims.

I claim:

1. A seat comprising multiple seat and back frames, upholstered seat and back cushions arranged on said frames, said seat cushions having upper and lower seating surfaces, tie-down tabs swivelly attached at their upper ends to the sides of said seat cushions substantially centermost thereof and depending below one of said seating surfaces, apertures in the depending ends of said tabs, hook means fixedly anchored in said seat frame adjacent the outer sides of said seat cushions and projecting upwardly and angularly therefrom, ear means on the free ends of said hook means, said ears being interengaged with said tab apertures, and generally U-shaped hook means with upwardly and angularly projecting arms extending at an angle of approximately 45 degrees and anchored to said frame between the adjoining sides of said seat cushions, and ears formed on the upper free ends of said arms for interengagement with said adjoining cushion tabs, and the ear means on the free ends of said hook means so interengages with said apertures in the tabs on adjoining sides of said cushions whereby both cushions are attached thereto and downward pressure exerted thereon to properly seat said cushions in said frames and prevent forward sliding movement thereof.

2. The invention defined by claim 1, wherein the other of said hook means being attached to said seat frame adjacent the opposite sides of said dual cushions, said hook means including a pair of posts having bent ears projecting laterally therefrom, whereby said ears on said posts and U-shaped arms interengage with said swivel tabs for permitting detachment of said ears from said tabs and manual reversal of either or both of said cushions.

* * * * *